United States Patent [19]

Kemper et al.

[11] 4,050,505

[45] Sept. 27, 1977

[54] JARRING MOULDING MACHINE

[75] Inventors: Gert Kemper, Rossdorf; Roland Melzer, Karlsruhe, both of Germany

[73] Assignee: Badische Maschinenfabrik GmbH, Germany

[21] Appl. No.: 574,340

[22] Filed: May 5, 1975

[30] Foreign Application Priority Data

May 10, 1974 Germany ..... 2422756

[51] Int. Cl.[2] ..... B22C 15/18; B28B 1/08

[52] U.S. Cl. ..... 164/206; 425/211; 173/131; 92/85 R

[58] Field of Search ..... 425/DIG. 58, 211, 425, 425/456; 164/284, 314, 203–206, 38, 39, 260, 196, 197; 173/DIG. 2, 126, 127, 131, 139; 259/1 R, DIG. 42, 72, 91; 181/36 R; 92/84, 85 R

[56] References Cited

U.S. PATENT DOCUMENTS

| | | | |
|---|---|---|---|
| 886,193 | 4/1908 | DeWitt | 173/131 |
| 1,609,136 | 11/1926 | Stevens | 173/139 X |
| 2,680,955 | 6/1954 | Templeton | 173/131 X |
| 2,889,811 | 6/1959 | Guillemier | 173/139 |
| 3,010,165 | 11/1961 | Olson | 164/39 |
| 3,270,375 | 9/1966 | Young | 164/206 |
| 3,273,469 | 9/1966 | Doyle | 173/139 X |
| 3,916,982 | 11/1975 | Blower et al. | 164/206 |

*Primary Examiner*—Francis S. Husar
*Assistant Examiner*—John S. Brown
*Attorney, Agent, or Firm*—Craig & Antonelli

[57] ABSTRACT

A jarring moulding machine having a table and impact receiving arrangement between the table and an anvil, which arrangement includes an annular impact member recessed into a surface of the anvil, and an impact insert of greater resilience than the impact member seated in an annular recess of step form at the inner periphery of the annular impact member. The top surface of the impact member projects slightly beyond of the anvil surface and the top surface of the impact insert projects slightly beyond of the top surface of the surrounding impact member so that the insert receives the impact before the impact member. The seating recess for the insert is undercut at the junction of its walls so as to leave a small clearance therebetween. The impact member may be of a polyethylene synthetic plastics material and the insert may be of rubbery polyurethane.

16 Claims, 2 Drawing Figures

JARRING MOULDING MACHINE

Figure 1:
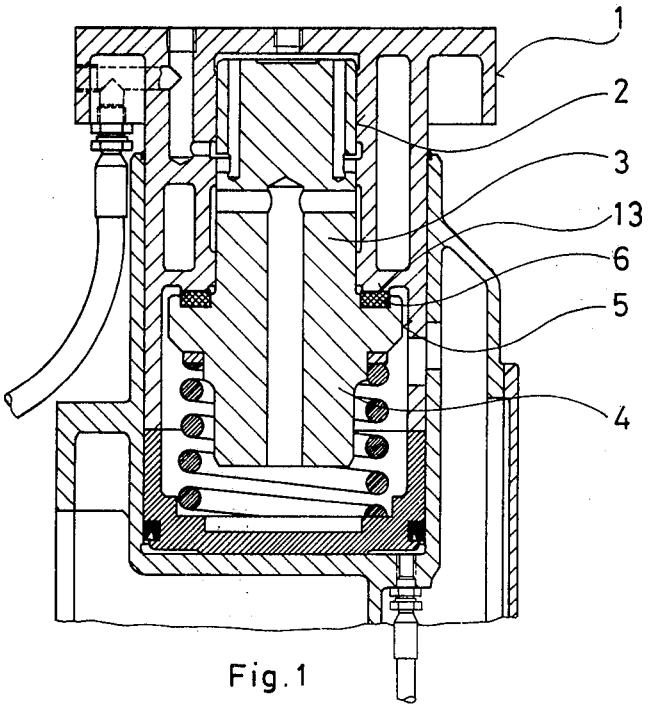

The invention relates to a jarring moulding machine having one or more impact members for the table, which are inserted into a supporting surface except for a small amount by which they project beyond the surface.

In the operation of jarring moulding machines, the impact surface of the table cooperates with an impact member arranged upon another part of the machine, and which is inserted into a supporting surface of said machine part. In such an arrangement the impact members involve difficulties in so far as they wear out relatively rapidly as well as giving rise to the noise nuisance well-known in such machines. Whilst, in the earlier types of jarring moulding machines the two parts engaged in the mutual impact consisted of metal, later examples have been modified in the direction of the use of white beech wood for the impact surfaces. At the present day the latter has been replaced by synthetic plastics, in particular those based on polyethylene, these synthetic plastics being of an extremely hard character. In the past this material has proved itself to be well suited for the impact members inserted in the supporting surface, because the material can stand up to the stresses which are imposed and wears out relatively slowly.

Nevertheless the burden of noise can hardly be reduced. The noise can only be controlled with difficulty because any damping of the noise is also accompanied with a mechanical damping effect on the jarring impact, which damping effect is not desirable. On the one hand the noise nuisance and on the other hand the efficiency of the jarring operation and the wear upon the impact members consequently impose incompatible requirements upon the construction. Indeed attempts have already been made to abate the noise by the use of softer impact materials, but these could not be successful because, firstly, they have too short a working life, and secondly they lead to a more rapid wear of the supporting surface in which they are inserted. This greater rate of wear at the supporting surface and upon the cavity receiving the impact member may be attributed to the intense squeezing work of the more resilient material. It has been found that there are always erosions at the impact surface, which are probably formed in consequence of the squeezing stress together with the presence of dust, sand and similar materials which have penetrated into the gap between the resilient material and the impact surface.

The present invention takes as its basic purpose the provision of a construction, which, whilst scarcely reducing the jarring intensity, will bring about a substantial reduction in the noise whilst the amount of wear remains practically the same.

According to the invention this problem is solved by the introduction of at least one impact insert which is resilient in relation to the impact member and which, upon impact, comes into effect before the impact member.

Whilst the impact member itself can be of conventional construction, the impact insert is arranged to be relatively softer and upon impact comes into effect first. Practical experiments have shown that with the use of this construction a substantial reduction of noise, for example in the order of magnitude of 10dB is achieved without having to make a substantial increase in the number of jarring impacts. Furthermore it has been shown that the amount of wear suffered by the impact insert consisting of the more resilient material is no greater, or hardly greater, than that of the hard material, because the former is not stressed up to the elastic limit, even though it absorbs the impact before this is taken by the harder impact member, but without the softer impact insert being further stressed as a consequence.

A practical embodiment of this basic concept of the invention is characterised in that the impact insert projects to a greater extent from the supporting surface than does the impact member. Accordingly the table first strikes the softer impact insert which has greater projection dimension and then strikes the harder impact member which projects to a lesser degree.

Preferably the impact member and the impact insert are arranged in concentric relationship. For example the impact insert can be arranged in a recess of the impact member, which is itself seated in the supporting surface.

In jarring moulding machines it is already known to have annular impact members which are recessed into the supporting surface. This arrangement allows the parts to be easily assembled and simply replaced. Furthermore, by arranging that the part which first receives the impact is situated at the inner side, the result is achieved that the volume of air which is dammed up at the inner side can more easily escape in an outward direction.

It is advantageous to undercut the recess of annular step in the impact member which receives the impact insert, and to do this in such a manner that the recess does not closely surround the impact insert. By adopting this arrangement it is possible for the insert consisting of the more resilient material to expand into the undercut portion of the impact member, there being provided an expansion space avoiding any overstressing of this part.

In conventional jarring moulding machines the impact member consists of a synthetic plastics material of the polythene type. As contrasted with this, in accordance with the present invention the impact insert is made of a rubber-elastic polyurethane or a functionally similar synthetic plastics material.

In the following there is described an embodiment of the invention with reference to the accompanying drawing, which shows in FIG. 1 a schematic cross section through a jarring moulding machine with an anvil vibrator, and in FIG. 2 a detail in axial cross section taken in the region of the supporting surface.

The jarring moulding machine shown in FIG. 1 includes a table 1 which supports a mould box, not shown in the drawing, this table being lifted by a cylinder 2, which slides upon a piston 3. During the jarring operation the impact surface 13 of the table 1 strikes an anvil 4, which has an impact surface 6 formed upon an annular extension 5. The further details visible in FIG. 1 are not essential for an understanding of the invention and are therefore not here described.

Figure 2:
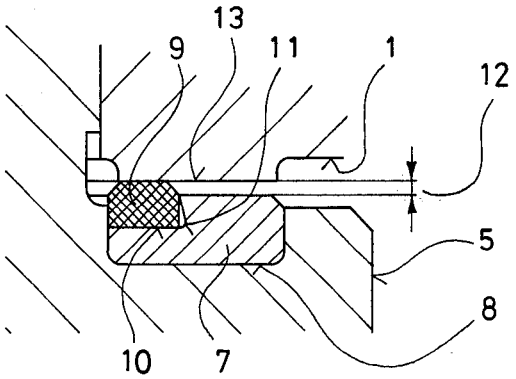

The impact device 6 is shown on an enlarged scale in FIG. 2. In the practical example here dealt with this comprises an annular impact member 7 and an annular impact insert 9 concentric with it. The impact member 7, which is formed of a comparatively hard material, is inserted into a cavity 8 of the annular extension 5 of the anvil 4 which forms the supporting surface. The impact insert 9 concentric with the impact member consists of a material softer than said impact member 7 and is recessed into an annular step 10 at the inner side of the impact member 7 so that it projects therebeyond. This step is provided with an undercut 11. The impact member 7 and the impact insert 9 are otherwise flush with each other at the inner side.

In the jarring operation the table 1 first strikes upon the impact insert 9 of the softer material and thereafter upon the impact member 7 consisting of the relatively harder material, this happening when the projecting portion of the impact insert 9 is compressed with respect to the impact member 7. Thereby the softer material of the impact insert 9 is squeezed into the undercut portion 11. The air compressed at the inner side during the jarring operation has adequate time to escape outwardly through the gap 12.

The invention is not restricted to the practical example with two concentric rings shown in the drawing. For example the impact insert 9 can consist of individual ring sections, or of flat members formed in any desired manner, just as the impact member 7 can also consist of flat members which can then be arranged in any advantageous symmetrical distribution upon the supporting surface. It is also possible to use a plurality of impact members of differing resilience and which project from the supporting surface to different extents, the height of the projecting portion being graded in accordance with the elasticity of the material.

We claim:

1. Jarring moulding machine having a table and an anvil member disposed for relative movement with respect to one another, an impact receiving means disposed between said table and a supporting surface of said anvil member, said impact receiving means comprising at least one impact member arranged in said supporting surface, for impact contact with said table resulting from this relative movement of the table and anvil member, and at least one impact insert which is resilient relative to the impact member and arranged in said impact member so that the impact insert receives impact contact with the table before the impact member.

2. Jarring moulding machine as claimed in claim 1, wherein the impact receiving surface of the impact insert projects beyond the supporting surface in the direction of the table which impacts therewith to a greater extent than does the impact member.

3. Jarring moulding machine as claimed in claim 1, wherein the impact member and the impact insert are concentrically arranged.

4. Jarring moulding machine as claimed in claim 1, wherein the impact insert is arranged in a recess of the impact member which member is itself let into the supporting surface.

5. Jarring moulding machine as claimed in claim 1, wherein the impact insert is annular and is seated in an annular step at the inner periphery of the annular impact member.

6. Jarring moulding machine as claimed in claim 5, wherein the annular step receiving the impact insert is undercut in such a manner that it does not closely surround the impact insert and allows a clearance for radial expansion of the insert under impact.

7. Jarring moulding machine as claimed in claim 1 having an impact member of polyethylene based synthetic plastics material and an impact insert of more resilient synthetic plastics material.

8. Jarring moulding machine as claimed in claim 7, wherein the impact insert consists of a polyurethane elastomer.

9. Jarring moulding machine comprising a table member and an anvil member, the table member and anvil member being movable with respect to one another, the anvil member being provided with a supporting surface and an impact member being disposed between the table member and the supporting surface for impact contact with the table member resulting from the movement of the table member and the anvil member with respect to one another and at least one impact insert means arranged in the impact member for impact contact with the table member prior to the impact contact by the impact member with the table member for reducing noise of the impact, the impact insert means being resilient relative to the impact member.

10. Jarring moulding machine as claimed in claim 9, wherein the impact insert means is provided with an impact receiving surface and the impact member is provided with an impact receiving surface, the impact insert means having the impact receiving surface thereof projecting beyond the supporting surface toward the table member which impacts therewith to a greater extent than the impact receiving surface of the impact member.

11. Jarring moulding machine as claimed in claim 9, wherein the impact member and the impact insert means are concentrically arranged.

12. Jarring moulding machine as claimed in claim 9, wherein the supporting surface is provided with a recess, the impact member being disposed in the recess of the supporting surface and having a recess therein, the impact insert means being disposed in the recess of the impact member.

13. Jarring moulding machine as claimed in claim 9, wherein the impact member is an annular member and is provided with an annular step at the inner periphery thereof, the impact insert means being an annular member seated at the annular step of the annular impact member.

14. Jarring moulding machine as claimed in claim 13, wherein the annular step for receiving the impact insert means is provided with an undercut portion which does not closely surround the impact insert means for permitting radial expansion of the impact insert means under impact into the undercut portion.

15. Jarring moulding machine as claimed in claim 9, wherein the impact member is a synthetic plastics material formed of polyethylene and the impact insert means is formed of a more resilient synthetic plastics material.

16. Jarring moulding machine as claimed in claim 15, wherein the impact insert means consists of a polyurethane elastomer.

* * * * *